US005127800A

United States Patent [19]

Hyll et al.

[11] Patent Number: 5,127,800

[45] Date of Patent: * Jul. 7, 1992

[54] FLOW-STABILIZING VOLUTE PUMP AND LINER

[75] Inventors: John Hyll; Harold Basmadjian, both of Sandy, Utah

[73] Assignee: Baker Hughes Incorporated, Houston, Tex.

[ * ] Notice: The portion of the term of this patent subsequent to Apr. 17, 2007 has been disclaimed.

[21] Appl. No.: 507,737

[22] Filed: Apr. 12, 1990

Related U.S. Application Data

[63] Continuation of Ser. No. 215,352, Jul. 5, 1988, Pat. No. 4,917,571, which is a continuation-in-part of Ser. No. 154,434, Feb. 9, 1988, abandoned, which is a continuation of Ser. No. 592,289, Mar. 20, 1984, abandoned.

[51] Int. Cl.[5] ..... F01D 1/02

[52] U.S. Cl. ..... 415/197

[58] Field of Search ..... 415/228, 52.1, 58.6, 415/203, 204, 206, 207, 208.2, 211.1, 214.1, 216.1, 200, 196–197, 128; 416/223 B, 186 R

[56] References Cited

U.S. PATENT DOCUMENTS

| | | | |
|---|---|---|---|
| 132,829 | 11/1972 | Harris . | |
| 834,848 | 10/1906 | Price . | |
| 1,107,591 | 8/1914 | DeHuff . | |
| 1,577,070 | 3/1926 | Orr | 415/228 |
| 1,585,669 | 5/1926 | Hansen . | |
| 2,163,464 | 6/1939 | Llewellyn . | |
| 2,190,245 | 2/1940 | Sartell . | |
| 2,312,422 | 3/1943 | Kumlin et al. . | |
| 2,353,871 | 7/1944 | Bowen . | |

(List continued on next page.)

FOREIGN PATENT DOCUMENTS

| | | |
|---|---|---|
| 29654 | 3/1891 | Fed. Rep. of Germany . |
| 1012183 | 7/1958 | Fed. Rep. of Germany . |
| 2220050 | 11/1973 | Fed. Rep. of Germany . |
| 2235193 | 2/1974 | Fed. Rep. of Germany . |
| 752623 | 9/1933 | France . |
| 972528 | 1/1951 | France . |
| 1167542 | 11/1958 | France . |
| 109987 | 3/1941 | Sweden . |
| 676760 | 7/1979 | U.S.S.R. . |
| 885615 | 11/1981 | U.S.S.R. . |

OTHER PUBLICATIONS

Schlichting, H., Boundary Layer Theory, N.Y.: McGraw Hill Book Co. (1979), pp. 525–526, 528–536.

Ash Pump Corporate Bulletin SRH/SRC-085, BGA International (1985).

Product Brochure Form 3759, Warman International, Inc. "Heavy-Duty Slurry Pumps", 12 pgs.

Product Brochure No. 557, Allen-Sherman-Hoff Pump Co., "Centriseal, Rubber-Lined Pumps", 4 pgs.

Addison, H., Centrifugal and Other Rotordynamic Pumps, 3rd Ed. London: Chapman & Hall (1966), pp. 47–53, 101–102.

Lazarkiewicz, S., et al., Impeller Pumps, Warsaw: Pergamon Press (1965), pp. 269–276, 280–281.

Pumping Manual, 7th Ed., Gulf Publishing Co., Houston, Tex.: Gulf Publishing Co. (1984), p. 389.

Cheremisinoff, N., Fluid Flow, Pumps, Pipe and Channels, Ann Arbor, Mich.: Ann Arbor Science Publishers, Inc. (1981) pp. 269,294,296.

*Primary Examiner*—Edward K. Look
*Assistant Examiner*—Christopher M. Verdier
*Attorney, Agent, or Firm*—Fleit, Jacobson, Cohn, Price, Holman & Stern

[57] ABSTRACT

Uniquely contoured interior surfaces have been found to stabilize the flow patterns through centrifugal pumps of the volute type, especially pumps having wide impellers and wide volutes for pumping slurries. The contoured interior surfaces may be provided in the pump casing, but are preferably defined by a volute liner. The interior surfaces comprise a volute region and a discharge nozzle region which both are at least in part contoured interior surfaces and which cooperate to provide a flowingly contoured interior surface of changing axial cross-section.

22 Claims, 7 Drawing Sheets

U.S. PATENT DOCUMENTS 2,471,174 5/1949 Trumpler .
2,515,398 7/1950 Derocher .
2,635,548 4/1953 Brawley .
2,851,289 9/1958 Pedersen .
2,992,617 7/1961 Kroeger .
2,999,628 9/1961 Crombie .
3,018,736 1/1962 Clay .
3,115,099 12/1963 Clay .
3,265,002 8/1966 Warman .
3,306,216 2/1967 Warman .
3,316,848 5/1967 Egger .
3,318,254 5/1967 Palmberg et al. .
3,460,748 8/1969 Erwin .
3,628,881 12/1971 Herrmann, Jr. ..... 415/228
3,656,861 4/1972 Zagar .
3,689,931 9/1972 Fortis .
3,743,437 7/1973 Warren .
3,758,227 9/1973 Pollak et al. .
3,824,029 7/1974 Cabri et al. .
4,213,742 7/1980 Henshaw .
4,234,291 11/1980 Hurst et al. .
4,264,273 4/1981 Grzina .
4,381,171 4/1983 Chapple .
4,917,571 4/1990 Hyll et al. ..... 415/197

FLOW-STABILIZING VOLUTE PUMP AND LINER

CROSS-REFERENCE TO RELATED APPLICATIONS

This is a continuation of application Ser. No. 215,352 filed Jul. 5, 1988, now U.S. Pat. No. 4,917,571, which is a continuation-in-part application of Ser. No. 154,434, filed Feb. 9, 1988, abandoned, which is a continuation of application Ser. No. 592,289, filed Mar. 20, 1984, abandoned.

FIELD OF THE INVENTION

The invention relates to centrifugal pumps of the volute type, and more particularly to modified pump casings and/or removable volute liners for pumps designed for pumping slurries.

BACKGROUND OF THE INVENTION

In conventional centrifugal pumps of the volute type, the section of the pump casing surrounding the periphery of the impeller is of changing cross-section. The outer peripheral profile is made to approximate a volute shape having a radius of curvature increasing to a maximum at a point where it becomes tangential to a discharge nozzle. Not only does the cross-sectional area of this volute section of the casing vary but the cross-sectional profile also varies around the periphery of the pump. The normal volute type casing therefore has a complex shape.

Centrifugal pumps are often fitted with replaceable abrasion resistant liners, especially pumps for pumping slurries. Refer, for example, to U.S. Pat. Nos. 4,243,291 to Hurst et al, "Wear Lining", and 4,264,273 to Grzina, "Casing and Casing Liners for Centrifugal Pumps of the Volute Type", the disclosures of which are herein incorporated by reference. These well-known liners generally have contours which essentially correspond to the contours of the pump casings into which they will be inserted.

Known also are casing liners having uniquely contoured interior surfaces which may or may not correspond to the interior wall configuration of the pump casing. Refer, for example, to U.S. Pat. No. 3,265,002 to Warman, "Centrifugal Pumps and the Like", the disclosure of which is herein incorporated by reference. The disclosure of Warman refers to obtaining gains in pump performance by controlling the shapes of the hydraulic passages in the volute region.

Regions of instability in pump performance profiles, where fluid flow through the pump becomes unstable, are well-known. Unstable flow through a pump is defined as an abrupt change in pressure or efficiency. A cyclic pattern of flow and pressure swings could trigger surging or vibration which is known to be damaging to both the pump and the system. Traditionally, high specific speed pumps and fans are characterized by an inherently unstable flow at low flow rates. The mechanism causing the instability in these cases is thought to be due to flow streamlines stalling or separating at the impeller inlet vanes. This condition is acknowledged and generally accepted in the industry such that pump or fan operation in such unstable zones is generally avoided.

In centrifugal pumps for pumping slurries, the unstable flow conditions can result from other mechanisms and/or parameters, such as "distorted", i.e., unusually wide (compared to the width of the impeller discharge opening) volute hydraulic passages. Slurry pumps typically have very wide impellers dictated by low velocity designs so as to minimize wear and provide the required thick shrouds to allow space for expellers or allowances for sacrificial wear. In slurry pumps, the combined thicknesses of the impeller shrouds adjacent the impeller discharge opening at the outer periphery of the impeller is typically at least approximately one-third to one-half the width of the recirculation zone at the outer periphery of the impeller. By contrast, the combined thicknesses of the impeller shrouds adjacent the impeller discharge opening at the outer periphery of the impeller of a clear water pump is a far smaller proportion of the width of the recirculation zone at the outer periphery of the impeller (i.e., typically only a maximum of about 0.14 the width of the recirculation zone) since clear water pump impellers have no sacrificial material applied thereto. The larger thicknesses of the impeller shrouds in slurry pumps causes an abrupt increase in cross-sectional flow area (i.e., approximately 50% or more) as the slurry flows radially outwardly from the impeller to the collector region of the volute and thus creates turbulent flow patterns not present in clear water pumps. In prior slurry pumps, such flow turbulence causes instabilities and inefficiencies. The increased thicknesses of the impeller shrouds in prior slurry pumps also results in the volute having a marked non-circular cross-sectional shape which prevents a smooth transition between the volute and discharge nozzle in conventional slurry pumps.

In the case of slurry pumps without expellers or with worn expellers, unstable flow has been found to occur closer to design point than is the case for clear water pumps. Aside from destructive surging or vibration, unstable flow in a slurry pump is known to accelerate wear due to the dissipation of energy. A sudden drop in pressure and efficiency is an index of this dissipation of energy. The loss in static pressure is believed to be due to turbulence or destructive high velocity vorticies, which occur in the zone of instability.

SUMMARY OF THE INVENTION

The purpose of the instant invention is to provide a volute pump having a uniquely contoured interior surface defined by the pump casing walls or a liner, which stabilizes the flow patterns therethrough, especially a pump having a wide impeller and wide volute for pumping slurries.

To accomplish this purpose, a centrifugal pump is provided comprising a casing, an impeller mounted in said casing having at least one impeller discharge opening in an outer periphery, a drive shaft extending axially for rotating said impeller mounted in said casing, a pair of side wall portions disposed opposite and spaced apart from one another, a volute passage defined by a volute wall portion connecting said pair of said side wall portions which has a fluid outlet discharge nozzle tangentially leading therefrom, said volute passage having a contoured interior surface with a volute region extending from a cutwater to a throat portion, said discharge nozzle extending outwardly from said throat portion, said contoured interior surface in the volute wall portion of the volute region comprising in axial cross-section a circumferentially extending recirculation region adjacent said outer periphery of said impeller extending away from said impeller, said contoured interior surface further comprising a circumferentially extending collector region radially outwardly of said recirculation region, the axial width of said collector region being less than the axial width of said recirculation region, said axial width of said recirculation region decreasing continuously at a first rate in a direction radially outwardly of said impeller, said axial width of said collector region decreasing continuously at a second rate in a direction radially outwardly of said impeller. The first rate may be greater than the second rate.

In accordance with one aspect of the invention, the recirculation region of the pump of the previous paragraph defines a pair of buffer zones on opposite sides of the impeller discharge opening which act to channel the flow exiting the impeller discharge opening into the collector region.

Stated more specifically, the purpose of the invention may be accomplished by providing a removable volute liner for a pump casing, comprising:

a) a pair of liner side wall portions disposed opposite and spaced apart from one another, one of the pair having an opening for receiving an impeller drive shaft, the other of the pair having a fluid inlet opening, and each wall portion having an exterior surface which matingly engages a corresponding portion of a casing interior surface; and b) a liner volute wall portion which connects together the pair of liner side wall portions when the liner is assembled within the casing and which has a fluid outlet discharge nozzle tangentially leading therefrom, the wall portion and the discharge nozzle each having an exterior surface which matingly engages a corresponding portion of the casing interior surface, and said volute wall portion including said fluid outlet discharge nozzle when assembled within the casing forming a complete volute liner passage around a pump impeller, which passage has a contoured interior surface, which is preferably arcuately contoured, having a volute region extending from a cutwater to a throat portion and a discharge nozzle region extending outwardly from the throat portion, the arcuately contoured interior surface in the volute wall portion of the volute region comprising in axial cross-section a trio of concave portions which are interconnected. Preferably, the interconnection is by a pair of convex portions. These portions cooperate to provide a flowingly contoured surface of changing axial cross-section in the volute wall portion of the volute region. In one embodiment, the concave portions comprise a central concave portion with a variable radius R flanked on each side by one of a pair of side concave portions having fixed radii $r_1$ and $r_2$, wherein R may vary from R greater than one of $r_1$ and $r_2$ near the cutwater to R less than or equal to one of $r_1$ and $r_2$ near the throat portion, said flowingly contoured surface extending past the throat portion into the discharge nozzle region wherein said surface gradually becomes circular in axial cross-section.

BRIEF DESCRIPTION OF THE DRAWINGS

The invention may be better understood by referring to the Detailed Description of the Invention when taken in conjunction with the accompanying drawings in which.

DETAILED DESCRIPTION OF THE INVENTION

Figure 1:
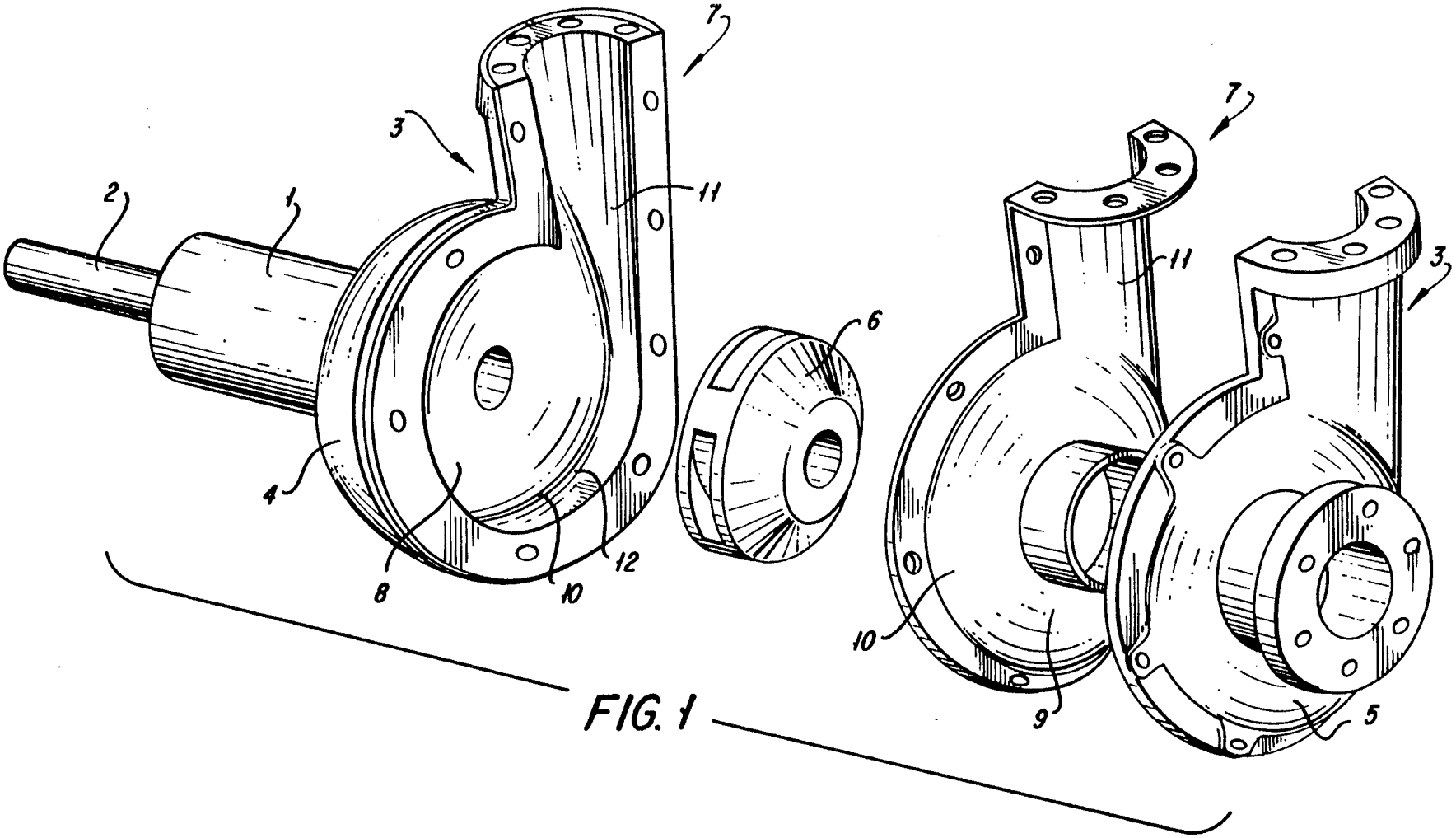
FIG. 1 is a break-away isometric view of a centrifugal pump showing an impeller drive shaft, a split pump casing, a two section removable volute liner, and an impeller.

In order to minimize static pressure losses, the collection of flow leaving the pump discharge openings of the impeller should be accomplished as smoothly as possible to minimize accelerations and decelerations of the fluid flow. The flow areas throughout the collector or volute are typically designed to achieve the best possible efficiency at a predetermined target flow by optimizing the hydraulic interaction between the impeller (with or without expeller vanes) and the volute. As previously discussed, a wide impeller can cause the volute passage to be "distorted", i.e., unusually wide (compared to the width of the impeller discharge opening), for the typically required flow area. As an example, a wide volute passage results for pumps having wide impellers, because a fixed width for a fixed flow area dictates a given average passage height. Tests have proven that this "distorted" volute passage shape results in flow instabilities, especially for impellers having no expeller vanes or having worn expeller vanes.

The uniquely contoured interior surfaces of this invention have been found to eliminate undesirable flow instabilities and by inference to stabilize the flow patterns through centrifugal pumps of the volute type. The interior surfaces may be defined by the pump casing, but are preferably defined by a volute liner. The volute interior surfaces comprise a volute region and a fluid outlet discharge nozzle region which define a volute passage and which are both at least in part contoured interior surfaces and, preferably, arcuately contoured interior surfaces.

These contoured interior surfaces cooperate to provide a flowingly contoured volute interior surface of changing axial cross-section which is believed to reduce fluid turbulence when the pump is operated, especially around the volute cutwater. The novel volute passage contours according to this invention preferably provide smooth, flowing transitions at all stations within the volute, e.g., from cutwater around to throat and out the discharge nozzle.

The volute liners of this invention may be manufactured from any suitable materials such as plastics; elastomers, such as a silicon elastomer; or rubbers, such as vulcanized rubber and neoprene. Alternatively, the liners may be manufactured of metal, such as white cast iron; metal alloys; and composite materials may be used, such as rubberized fabrics including but not limited to, for example, a fiberglass reinforced molded neoprene liner. The replaceable liners serve to prevent wear to the interior of the pump casing and choice of materials is dictated by the fluids to be pumped, as is well-known in the art.

A preferred embodiment according to this invention is a multi-piece liner having two or more sections. Sections which are subject to greater wear may thus be singly and more frequently replaced. The liner may be manufactured and split into as many sections as desired. For example, when the liner is a two-section or two-piece liner, the liner may be split though a plane which extends perpendicularly to the longitudinal axis of the impeller drive shaft or through the same plane as the longitudinal axis of the impeller drive shaft, or through any other plane.

A centrifugal pump of the volute type includes a pump casing which surround an impeller and a drive shaft for rotating the impeller. The casing is typically comprised of a pair of side wall portions disposed opposite and spaced apart from one another. One of the pair of side wall portions has an opening for receiving the impeller drive shaft which has a longitudinal axis. The other of the pair of side wall portions has a fluid inlet opening. The pair of side wall portions lie in planes which extend generally in the same planes as the side wall portions of the impeller. The casing is further comprised of a volute wall portion which connects together the pair of side wall portions and has a fluid outlet opening. A casing interior is comprised of the interior surfaces of said pair of side wall portions and said volute wall portion including said fluid outlet opening. The casing in general is split into two halves. The casing halves sealingly engage one another and cooperate to form a complete volute passage around the pump impeller when the pump is assembled.

The contoured interior surface in the volute wall portion of the volute region, according to this invention, comprises in axial cross-section, a circumferentially extending recirculation region adjacent the outer periphery of the impeller, which extends away from the impeller. The contoured interior surface further comprises a circumferentially extending collector region radially outwardly of said recirculation region. The axial width of the collector region is preferably at least equal to or greater than the width of the impeller discharge opening of said impeller and is less than the axial width of the recirculation region. The axial width of the recirculation region decreases continuously at a first rate in a direction radially outwardly of the impeller. The axial width of the collector region decreases continuously at a second rate in a direction radially outwardly of the impeller. The first rate is preferably greater than the second rate. There may be a sharp inflection point as the first rate changes to the second rate, where the rate of change may become very large.

The recirculation region may further include a pair of buffer zones on opposite sides of the impeller discharge opening. These zones each extend in axial cross-section from the impeller shrouds to the wall defining the recirculation region. The impeller shrouds extend from the impeller discharge opening to the side walls of the impeller. The buffer zones act to channel the flow exiting the impeller discharge opening into the collector region. Flow deceleration is believed to be minimized thereby. These zones provide an area for some recirculation and dead pocket flow over the impeller shrouds to be discharged smoothly out the discharge nozzle with a reduced amount of turbulence at the cutwater. In any event, the resulting stable pump performance indicates that main flow decelerations have been minimized by the provision of these buffer zones (as will be discussed further in the Work Example to follow), which act to channel said main flow.

Preferably, this contoured interior surface is arcuately contoured and comprises in axial cross-section a trio of concave portions which are interconnected, most preferably the interconnection being by a pair of convex portions which cooperate to provide a flowingly contoured surface of changing axial cross-sections in the volute wall portion of the volute region. The concave portions comprise a central concave portion (which corresponds to the collector region) with a radius R, which radius R is preferably variable and is most advantageously greater near the cutwater and gradually varies to a radius R which is smaller near the throat portion.

In this preferred embodiment, the central concave portion is flanked on each side by one of a pair of side concave portions having radii $r_1$ and $r_2$, which are preferably fixed, but may be variable. Depending on the type of impeller, $r_1$ may equal $r_2$ or be different from $r_2$ and one of $r_1$ and $r_2$ may be fixed and the other variable. Central concave portion radius R may vary from R greater than one of $r_1$ and $r_2$ near the cutwater to R less than or equal to one of $r_1$ and $r_2$ near the throat portion.

The central concave portion and the pair of side concave portions are interconnected. Interconnection most preferably is by a pair of convex portions, one of said pair of convex portions on either side of the central concave portion. The radii of the pair of convex portions are selected so as to provide a flowingly contoured surface of changing axial cross-section in the volute wall portion of the volute region. The flowingly contoured surface extends, moreover, past the throat portion, into the discharge nozzle region wherein said surface gradually becomes circular in axial cross-section.

Referring to FIG. 1, a two section liner according to this invention is shown in a break-away isometric view of the pertinent portion of a centrifugal pump. The pump comprises a bearing housing 1 having a shaft 2. The casing, shown generally at 3, is a split casing having a first section 4 and a second section 5, the two casing sections 4, 5 (shown as symmetrical halves) being so constructed as to matingly engage, and being provided with a closure means (not shown), which is generally an array of nuts and bolts. The impeller 6 is surrounded by a liner shown generally as 7 when the pump is assembled. The liner 7 is shown as a two section liner having a pair of wall portions 8 and 9 and a volute wall portion 10 which includes a discharge nozzle 11. The interior 12 of the volute wall portion 10 is shown as having a uniquely contoured surface which is the subject of this invention.

Figure 2:
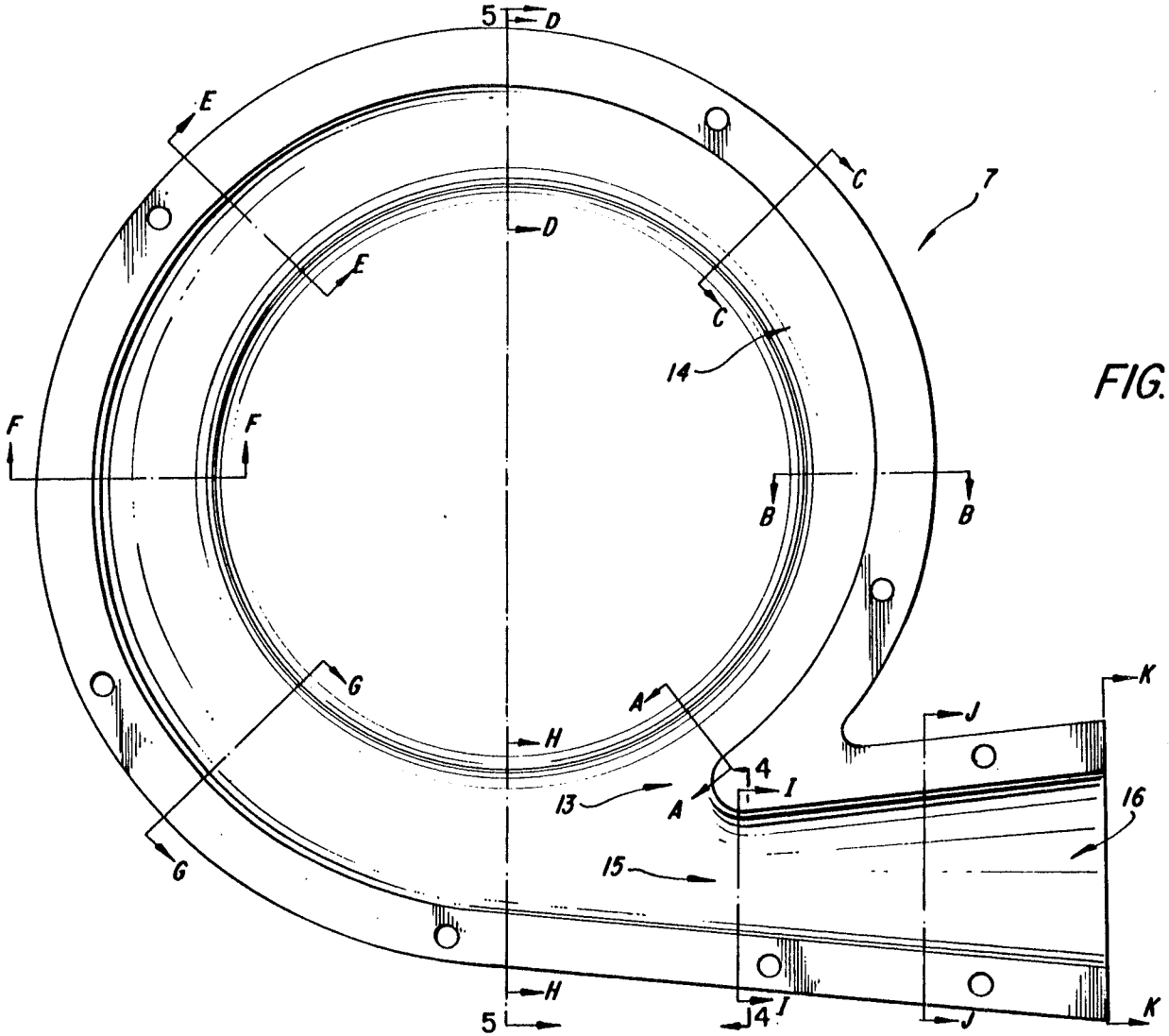
FIG. 2 is an inside view showing half of a two section liner.

Referring to FIG. 2, shown is an inside view of half of a two section liner 7. The volute shape (i.e., spiral shape) is most apparent in this view. The volute shape may be either an ideal volute shape or, as a matter of design and fabrication convenience, it may be a modified volute shape. Shown generally in this view is the cutwater 13 of the volute region shown generally at 14. The volute region 14 extends from this cutwater 13 to a throat portion shown generally at 15. The discharge nozzle region shown generally at 16 extends outwardly from the throat portion 15 to a connection means (not shown) which may be a pipe.

Figure 3A:
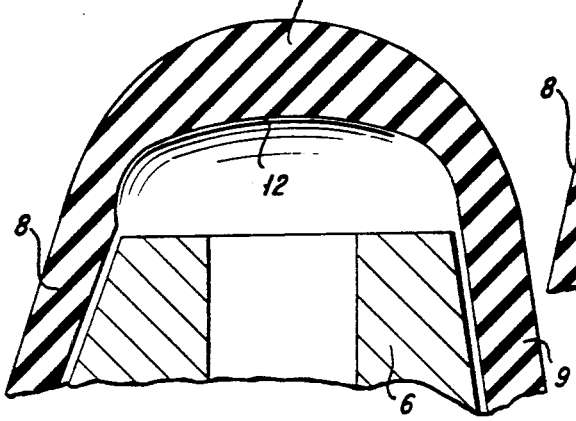
FIGS. 3A through 3H are partial axial cross-sections and FIGS. 3I through 3K are axial cross-sections at various section lines A through K (see FIG. 2).
Figure 3D:
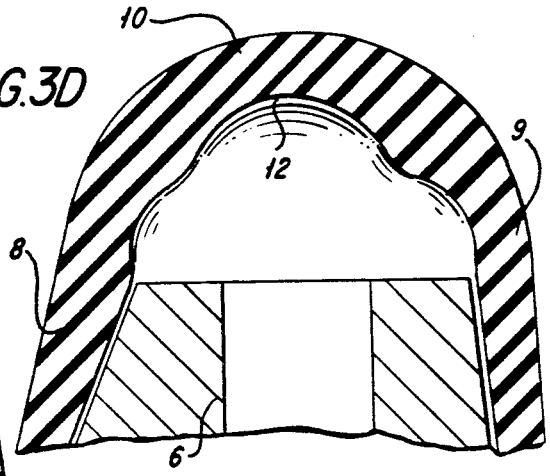
Figure 3B:
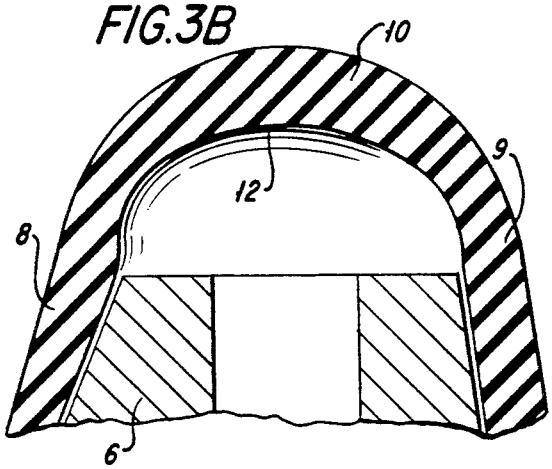
Figure 3E:
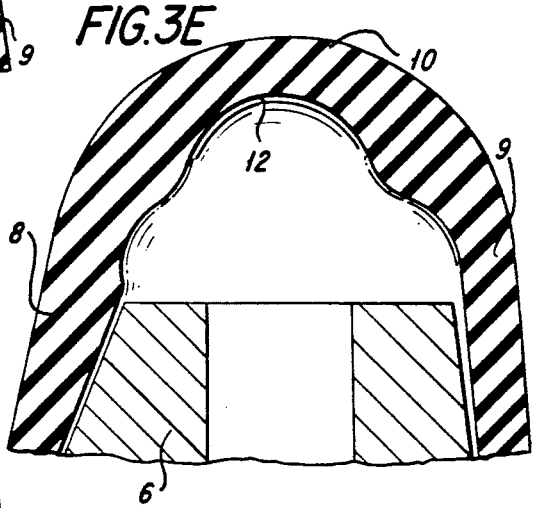
Figure 3C:
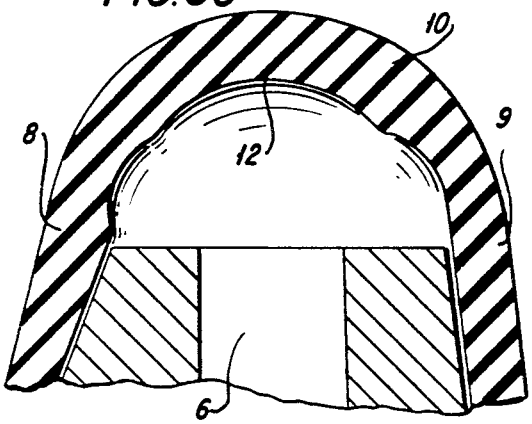
Figure 3F:
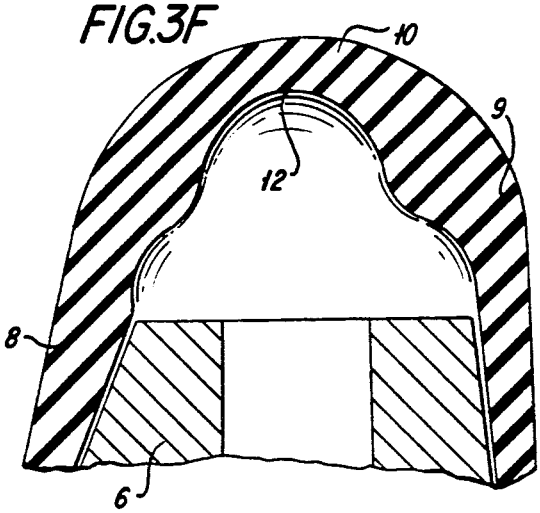
Figure 3G:
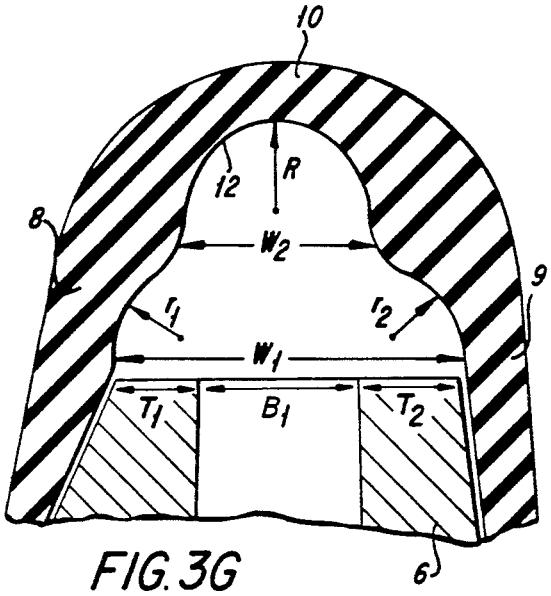
Figure 3I:
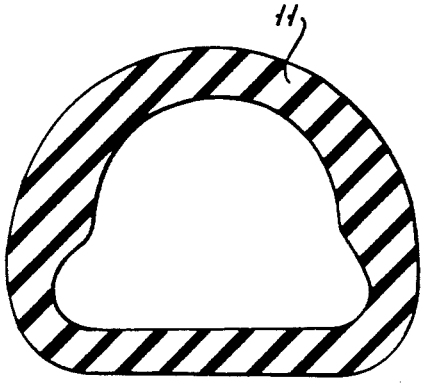
Figure 3H:
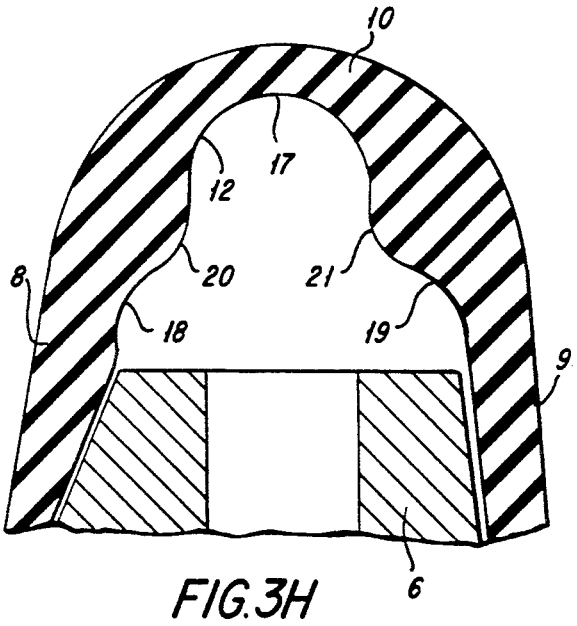
Figure 3J:
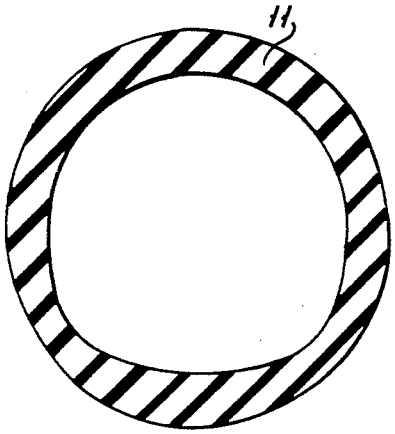
Figure 3K:
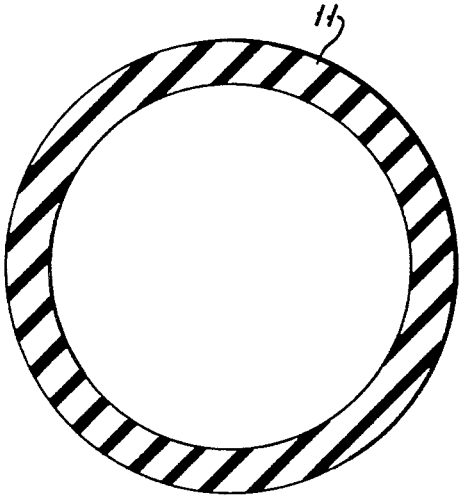

FIG. 2 is provided with section lines A through K so that the interior contour 12 of the volute wall portion 10 (shown without split section lines) may be better understood in FIGS. 3A through 3K. FIGS. 3A through 3H are partial axial cross-sections at various section lines A through H. FIGS. 3I through 3K are axial cross-sections at various section lines I through K.

Referring to FIG. 3H, a partial axial cross-section through section line G of the interior contour 12 of the volute wall portion 10 according to this invention as viewed from the interior of the liner (without any split section lines) is shown. Section G is selected from upstream of the throat region shown generally at 15. This view clearly shows the arcuately contoured interior surface 12 of the volute wall portion 10 in the volute region 14. Shown are a trio of concave portions interconnected by a pair of convex portions which cooperate to provide a flowingly contoured surface. A central concave portion 17 having a radius R is flanked on each side by one of a pair of side concave portions 18 and 19, having a radii $r_1$ and $r_2$, respectively. The central concave portion 17 and the pair of side concave portions 18 and 19 are interconnected by a pair of convex portions 20 and 21 which cooperate to provide the flowingly contoured surface of changing axial cross-section according to this invention. The contoured interior surface in the volute wall portion of the volute region adjacent the cutwater (see FIG. 3A) is free of convex portions and thus is free of distinct recirculation and collector regions. It presents a single concave portion. The contoured interior surface has a smooth, generally uniform surface transition along the length of the volute passage from the cutwater portion of the throat portion in the direction of rotation of the impeller, as shown in FIGS. 2 and 3A through 3H. As will be understood by those skilled in the art, in FIG. 2 the impeller (not shown) would rotate counterclockwise from section A—A to section H—H. FIG. 3G also shows the recirculation zone having a width $w_1$ and the collector zone having a width $w_2$. As shown in FIG. 3G, the combined thicknesses $T_1$ and $T_2$ of the impeller shrouds of a slurry pump, such as herein disclosed, adjacent the impeller discharge opening $B_1$ at the outer periphery of the impeller is a significant proportion of the width $w_1$ of the recirculation zone at the outer periphery of the impeller (i.e., $T_1$ and $T_2$ together are at least approximately one-third, and more typically at least approximately one-half, the width $w_1$ of the recirculation zone). The slurry exiting the impeller discharge opening $B_1$ in FIG. 3G is thus presented with an abrupt and substantial increase in cross-sectional flow areas (i.e., an increase of at least approximately 50%) which tends to create turbulence. In contrast, a clear water pump having a ratio of 0.14 of the total shroud thickness to the width of the recirculation zone presents an increase in flow areas of only 16%. FIGS. 3A through 3H serially show the changing axial cross-section of the volute around the periphery thereof.

The flowingly contoured surface of the interior 12 of the volute wall portion 10 in the volute region 14 extends past the throat portion shown generally at 15 into the discharge nozzle region shown generally at 16, wherein the surface gradually becomes circular in axial cross-section. Referring to FIGS. 3I through 3K, which are axial cross-sections through section lines I, J, and K, respectively, the flowingly contoured surface is serially shown to extend past the throat portion 15 into the discharge nozzle region shown generally at 16. Within the discharge nozzle region 16, the flowingly contoured surface gradually becomes circular in axial cross-section as shown in FIG. 3K.

Figure 4:
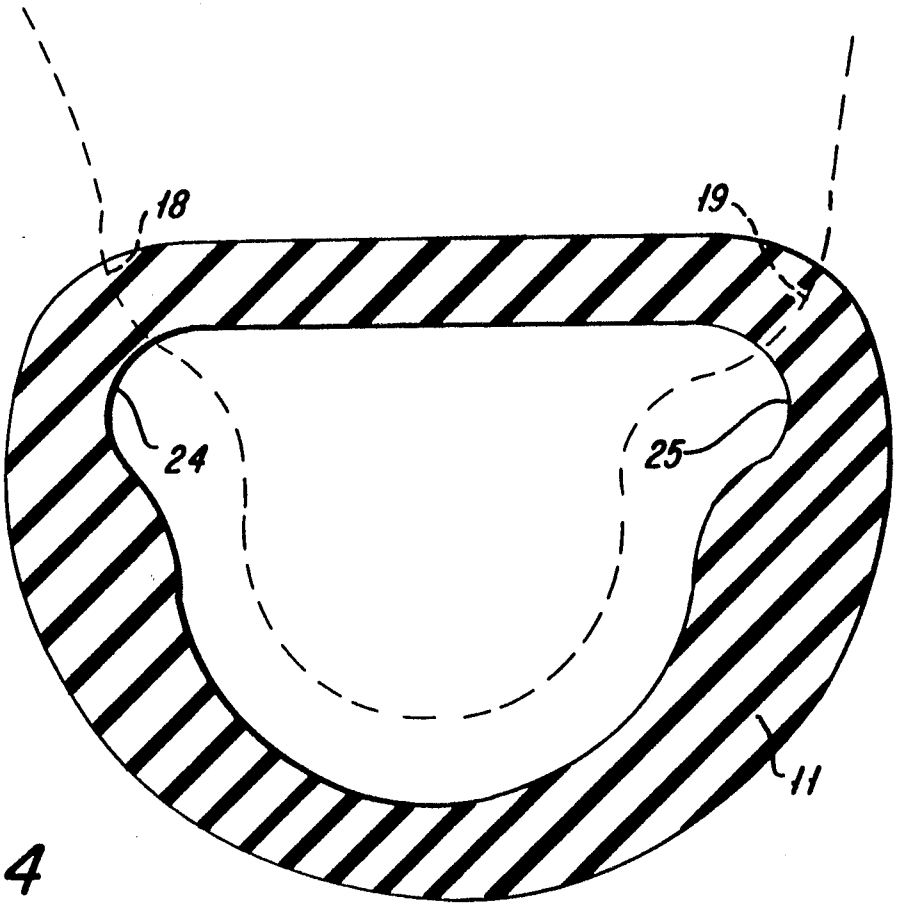
FIG. 4 is an axial cross-sectional view through section line I (see FIG. 2) showing a partial axial cross-section view through section line H (see FIG. 2) in phantom.

FIG. 4 is an axial cross-sectional view (without split section lines) through section line I (see FIG. 2) showing a partial axial cross-sectional view through section line H (see FIG. 2) in phantom. This FIGURE more clearly shows the smooth transition of the interior contours of the volute region as they flowingly move into the discharge nozzle region. Shown clearly also is the slight asymmetry of this example of the uniquely contoured surfaces according to this invention, which results from the fact that radii $r_1$ and $r_2$ of side concave portions 18 and 19 are not shown as equal. As shown in FIG. 4, the nozzle at section line I includes concave portions 24 and 25 which are positioned to bleed off a portion of the flow from the recirculation zone.

Figure 5:
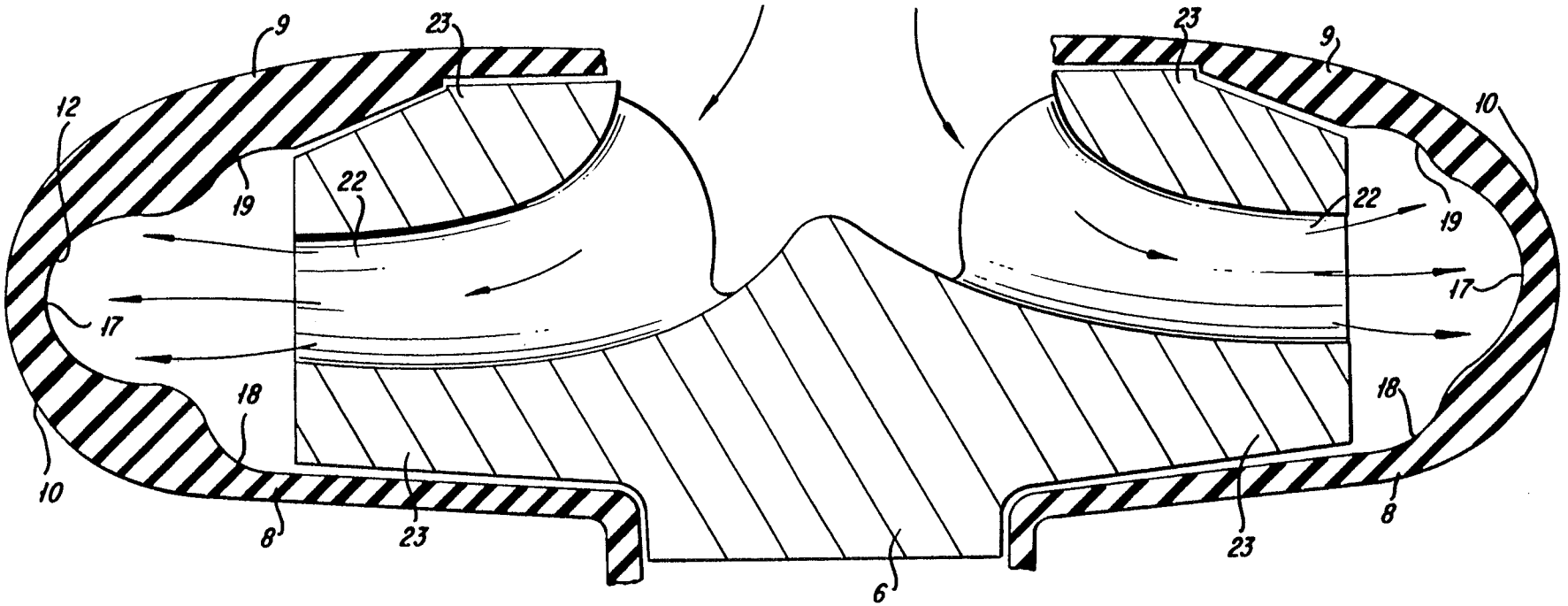
FIG. 5 is an axial cross-sectional view through section line 5 (see FIG. 2) showing the general flow of fluid from the impeller discharge openings into the collector regions of the volute passage.

FIG. 5 is an axial cross-sectional view through section line 5 (see FIG. 2). The general flow of fluids from the impeller discharge openings 22 is shown. The central concave portion 17 (the collector region) is shown as having an axial width which is slightly greater than the width of the impeller discharge openings 22 and as serving to receive the main flow from the impeller discharge openings 22.

Referring to FIG. 5, the pair of buffer zones extend in axial cross-section from the impeller shrouds 23 to the walls of the side concave portions 18 and 19. The buffer zones channel the main flow from the impeller discharge openings 22 into the collector region as generally shown by the flow arrows in FIG. 5.

WORKING EXAMPLE

Figure 6:
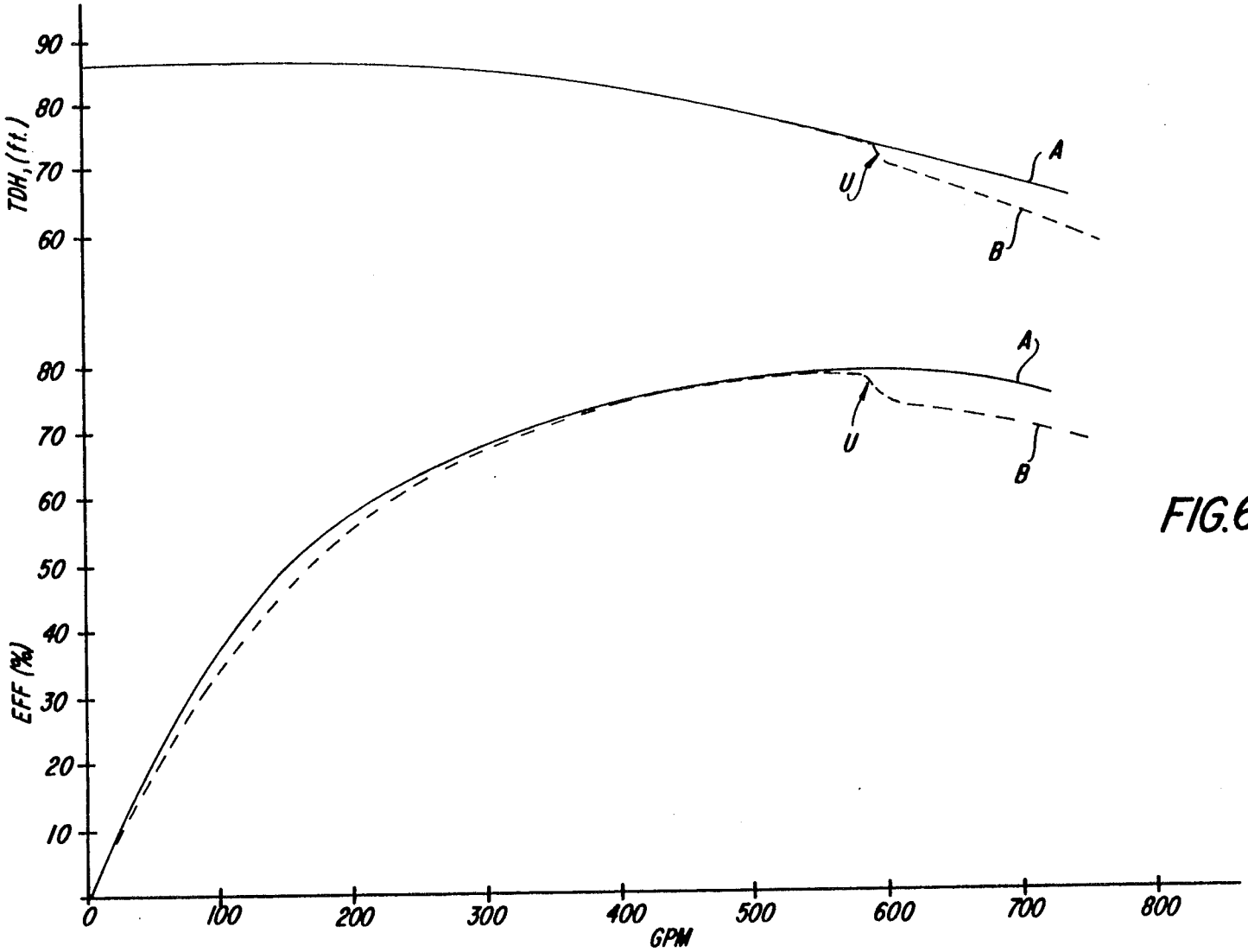
FIG. 6 is a pump performance graph.

With reference to FIG. 6, a pump performance graph is shown which compares the performance of a pump having a volute liner according to the instant invention, liner A, with that of a pump having a volute liner typically encountered in industry, liner B. Test volute liner B had a continuously arcuately concave surface when viewed from the interior of the liner, and had a variable radius R.

Full-sized model pumps, each having a design point of 600 GPM, were fitted with removable volute liners A and B and performance tested with water. With reference to FIG. 6, test results are set forth for each liner design run at 1,270 RPM in a 5×4 model pump with the same impeller, but with no expeller vanes. It is seen that unstable flow sets in very close to the design point (600 GPM) for the volute liner generally according to the prior art, liner B, indicated by B on the graph. Note the abrupt change in total dynamic head, TDH (pressure) with flow rate as well as the abrupt change in efficiency with flow rate, as measured by a non-contact strain gauge type torque sensor, for this liner. Flow rate was measured by a magnetic flow meter in series with a turbine flow meter. Dual measurements with duplicate instrumentation were taken at all times. This abrupt change is characteristic of a region of instability where fluid flow through a pump becomes unstable, indicated generally by U. This unstable flow characteristic was previously discussed.

By comparison, the volute liner according to this invention, liner A, indicated by A on the graph, exhibits slightly higher efficiency without any instability. This is considered to be a most significant finding and is believed to be due to the novel, flowingly contoured volute liner interior surfaces according to the instant invention.

In the Working Example, the removable volute liners A and B were performance tested with water. If the performance tests were made with abrasive slurry, similar performance results would be anticipated such that a flow rate of around 600 GPM, for the same TDH (pressure), higher speed and more power would be required for the conventional unstable volute liner B by inference from the comparative performance curve of FIG. 6. It is therefore believed reasonable to conclude that the extra power would be absorbed by a fluid in the form of turbulence, which in turn would act to accelerate wear compared to the stable volute liner A according to this invention, without the turbulence.

Thus the flow-stabilizing interior surface contours for the casings or the volute liners according to this invention provide improved flow stability for centrifugal pumps in operation, especially for pumps designed for pumping slurries. Increased wear life for the volute liners according to this invention compared to the wear life for similar volute liners according to the prior art, is anticipated. An increased mechanical life, due to the absence of flow surges and vibration, is anticipated for pumps and parts thereof which include these novel interior contours. Anticipated also is higher pumping efficiency.

While the instant invention has been described by reference to what is believed to be the most practical embodiments, it is to be understood that the invention may embody other specific forms not departing from the spirit of the central characteristics of the invention. It should be understood that there are other embodiments which possess the qualities and characteristics which would generally function in the same manner and should be considered within the scope of this invention. The present embodiments therefore should be considered in all respects as illustrative and not restrictive, the scope of the invention being limited solely to the appended claims rather than the foregoing description and all equivalents thereto being intended to be embraced therein.

We claim:

1. A centrifugal pump adapted to pump slurries of abrasive material comprising a casing, an impeller mounted in said casing having a relatively thick shroud at each side thereof defining therebetween at least one impeller discharge opening in an outer periphery of the impeller, a drive shaft extending axially for rotating said impeller mounted in said casing, a pair of side wall portions disposed opposite and spaced apart from one another, a volute passage defined by a volute wall portion connecting said pair of said side wall portions which has a fluid outlet discharge nozzle tangentially leading therefrom, said volute passage having a contoured interior surface with a volute region extending from a cutwater to a throat portion, said discharge nozzle extending outwardly from said throat portion, said contoured interior surface in the volute wall portion of the volute region adjacent the throat portion comprising in axial cross-section a circumferentially extending recirculation region adjacent said outer periphery of said impeller extending away from said impeller, said contoured interior surface further comprising a circumferentially extending collector region radially outwardly of said recirculation region, said recirculation region and said collector region being interconnected by a pair of generally convex portions, the axial width of said collector region being less than the axial width of said recirculation region, said recirculation region including a pair of buffer zones on opposite sides of said impeller discharge opening which act to channel the flow exiting said impeller discharge opening into said collector region for limiting flow turbulence in the slurry flowing radially outwardly from the impeller discharge opening to the collector region, said contoured interior surface in the volute wall portion of the volute region adjacent the cutwater portion being free of convex portions and thus free of distinct recirculation and collector regions, with said contoured interior surface having a smooth, generally uniform surface transition along the length of the volute passage from the cutwater portion to the throat portion in the direction of rotation of the impeller.

2. A centrifugal slurry pump adapted to pump slurries of abrasive material comprising a casing, an impeller mounted in said casing having a relatively thick shroud at each side thereof defining therebetween at least one impeller discharge opening in an outer periphery of the impeller, a drive shaft extending axially from rotating said impeller mounted in said casing, a pair of side wall portions disposed opposite and spaced apart from one another, a volute passage defined by a volute wall portion connecting said pair of said side wall portions which has a fluid outlet discharge nozzle tangentially leading therefrom, said volute passage having a contoured interior surface with a volute region extending from a cutwater to a throat portion, said discharge nozzle extending outwardly from said throat portion, said contoured interior surface in the volute wall portion of the volute region adjacent the throat portion comprising in axial cross-section a circumferentially extending recirculation region adjacent said outer periphery of said impeller extending away from said impeller, said contoured interior surface further comprising a circumferentially extending collector region radially outwardly of said recirculation region, the axial width of said collection region being less than the axial width of said recirculation region, said discharge nozzle being of generally circular section at its outer peripheral discharge end, said discharge nozzle at its inner end, constituting said throat portion, and the areas defined by the volute and the outer periphery of the impeller adjacent to and upstream of the throat portion being of generally similar non-circular, generally polygonal shape as viewed in axial cross-section, with the discharge nozzle being so sized and shaped in axial section along its length as to provide a smooth interior surface transition from said non-circular to said circular sectional shape for limiting turbulence in the flow of the slurry along the discharge nozzle.

3. A removable volute liner for a centrifugal pump of the volute type adapted to pump slurries of abrasive material, said pump including a pump casing, an impeller mounted in said casing having a relatively thick shroud at each side thereof defining therebetween at least one impeller discharge opening in an outer periphery of the impeller, and a drive shaft extending axially for rotating said impeller mounted in said casing, said removable volute liner for said pump casing comprising a volute wall portion having a fluid outlet discharge nozzle tangentially leading therefrom and adapted to define a volute passage around said outer periphery of said impeller, said volute passage having a contoured interior surface with a volute region extending from a cutwater to a throat portion, said discharge nozzle extending outwardly from said throat portion, said contoured interior surface in the volute wall portion of the volute region adjacent the throat portion comprising in axial cross-section a circumferentially extending recirculation region adapted to be positioned adjacent said outer periphery of said impeller and to extend away from said impeller, said contoured interior surface further comprising a circumferentially extending collector region radially outwardly of said recirculation region, said recirculation region and said collector region being interconnected, the axial width of said collector region being less than the axial width of said recirculation region, said recirculation region including a pair of buffer zones on opposite sides of said impeller discharge opening which act to channel the flow exiting said impeller discharge opening into said collector region for slurry flowing radially outwardly from the impeller discharge opening to the collector region, said contoured interior surface in the volute wall portion of the volute region adjacent the cutwater portion being free of distinct recirculation and collector regions, with said contoured interior surface having a smooth, generally uniform surface transition along the length of the volute passage from the cutwater portion to the throat portion in the direction of rotation of the impeller.

4. A removable volute liner for a centrifugal pump of the volute type adapted to pump slurries of abrasive material, said pump including a pump casing, an impeller mounted in said casing having a relatively thick shroud at each side thereof defining therebetween at least one impeller discharge opening in an outer periphery of the impeller, and a drive shaft extending axially for rotating said impeller mounted in said casing, said removable volute liner for said pump casing comprising a volute wall portion having a fluid outlet discharge nozzle tangentially leading therefrom, to define a volute passage, said volute passage having a contoured interior surface with a volute region extending from a cutwater to a throat portion, said discharge nozzle extending outwardly from said throat portion, said contoured interior surface in the volute wall portion of the volute region adjacent the throat portion comprising in axial cross-section a circumferentially extending recirculation region adapted to be positioned adjacent said outer periphery of said impeller and to extend away from said impeller, said contoured interior surface further comprising a circumferentially extending collector region radially outwardly of said recirculation region, the axial width of said collector region being less than the axial width of said recirculation region, said collector region being interconnected with said recirculation region to provide a flowingly contoured surface of changing axial cross-section in said volute wall portion of said volute region, said recirculation region including a pair of buffer zones adapted to be positioned on opposite sides of said impeller discharge opening which act to channel the flow exiting said impeller discharge opening into said collector region for limiting flow turbulence in the slurry flowing radially outwardly from the impeller discharge opening to the collector region, said contoured interior surface in the volute wall portion of the volute region adjacent the cutwater portion being free of distinct recirculation and collector regions, with said contoured interior surface having a smooth, generally uniform surface transition along the length of the volute passage from the cutwater portion to the throat portion in the direction of rotation of the impeller.

5. A removable volute liner for a centrifugal pump of the volute type adapted to pump slurries of abrasive material, said pump including a pump casing which surrounds an impeller having a relatively thick shroud at each side thereof defining therebetween at least one impeller discharge opening in the outer periphery of the impeller and a drive shaft for rotating said impeller, said removable volute liner for said pump casing comprising a pair of side wall portions disposed opposite and spaced apart from one another, said wall portions lying in planes which extend generally perpendicularly to the longitudinal axis of the shaft, a liner volute wall portion which connects together said pair of side wall portions when the liner is assembled within the casing and which has a fluid outlet discharge nozzle tangentially leading therefrom, said volute wall portion when assembled within the casing forming a complete volute liner passage around said pump impeller, which passage has an arcuately contoured interior surface having a volute region extending from a cutwater to a throat portion and a discharge nozzle region extending outwardly from the throat portion, the arcuately contoured interior surface in the volute wall portion of the volute region adjacent the throat portion comprising in axial cross-section a recirculation region having a trio of generally concave portions which are interconnected by a pair of generally convex portions and which cooperate to provide a flowingly contoured surface of changing axial cross-section in the volute wall portion of the volute region, said contoured interior surface in the volute wall portion of the volute region adjacent the cutwater portion being free of convex portions and thus presenting only a single concave portion, with said contoured interior surface having a smooth, generally uniform surface transition along the length of the volute passage from the cutwater portion to the throat portion in the direction of rotation of the impeller.

6. A removable volute liner for a centrifugal pump of the volute type adapted to pump slurries of abrasive material, said pump including a pump casing which surrounds an impeller having a relatively thick shroud at each side thereof defining therebetween at least one impeller discharge opening in the outer periphery of the impeller and a drive shaft for rotating said impeller, said removable volute liner for said pump casing comprising a pair of side wall portions disposed opposite and spaced apart from one another, one of the pair having an opening for receiving said impeller drive shaft, the other of the pair having a fluid inlet opening, said wall portions lying in planes which extend generally perpendicularly to the longitudinal axis of the shaft, a liner volute wall portion which connects together the pair of side wall portions when the liner is assembled within the casing and which has a fluid outlet discharge nozzle tangentially leading therefrom, said side wall portions and said volute wall portion including said fluid outlet discharge nozzle cooperating when assembled within the casing to form a complete volute liner passage around said pump impeller, which passage has an arcuately contoured interior surface having a volute region extending from a cutwater to a throat portion and a discharge nozzle region extending outwardly from the throat portion, the arcuately contoured interior surface in the volute wall portion of the volute region adjacent the throat portion comprising in axial cross-section a recirculation region having a trio of concave portions interconnected by a pair of convex portions which cooperate to provide a flowingly contoured surface of changing axial cross-section in the volute wall portion of the volute region, said concave portions comprising a central concave portion with a radius R flanked on each side by one of a pair of side concave portions having a radii $r_1$ and $r_2$, wherein R may vary from R greater than one of $r_1$ and $r_2$ near the cutwater to R less than or equal to one of $r_1$ and $r_2$ near the throat portion, said contoured interior surface in the volute wall portion of the volute region adjacent the cutwater portion being free of convex portions and thus presenting only a single concave portion, with said contoured interior surface having a smooth, generally uniform surface transition along the length of the volute passage from the cutwater portion to the throat portion in the direction of rotation of the impeller.

7. A removable volute liner for a centrifugal pump of the volute type adapted to pump slurries of abrasive material, said pump including a pump casing which surrounds an impeller having a relatively thick shroud at each side thereof defining therebetween at least one impeller discharge opening in the outer periphery of the impeller and a drive shaft for rotating said impeller, said casing comprising a pair of wall portions disposed opposite and spaced apart from one another, one of the pair having an opening for receiving an impeller drive shaft having a longitudinal axis, the other of the pair having a fluid inlet opening, and said pair lying in planes which extend generally perpendicularly to the longitudinal axis of the shaft; a volute wall portion which connects together the pair of wall portions and has a fluid outlet opening; and a casing interior comprised of the interior surfaces of said pair of wall portions and said volute wall portion including said fluid outlet opening, said casing being split into two halves, said halves sealingly engaging one another and cooperating to form a complete volute passage around said pump impeller when the pump is assembled, said removable volute liner for said pump casing comprising:

a. a pair of liner side wall portions disposed opposite and spaced apart from one another, one of the pair having an opening for receiving said impeller drive shaft, the other of the pair having a fluid inlet opening, said wall portions lying in planes which extend generally perpendicularly to the longitudinal axis of the shaft, and each wall portion having an exterior surface which matingly engages a corresponding portion of the casing interior surface; and b. a liner volute wall portion which connects together the pair of side wall portions when the liner is assembled within the casing and which has a fluid outlet discharge nozzle tangentially leading therefrom, the wall portion and the discharge nozzle each having an exterior surface which matingly engages a corresponding portion of the casing interior surface, and said liner volute wall portion including said fluid outlet discharge nozzle when assembled within the casing forming a complete volute liner passage around said pump impeller, which passage has an arcuately contoured interior surface having a volute region extending from a cutwater to a throat portion and a discharge nozzle region extending outwardly from the throat portion, the arcuately contoured interior surface in the volute wall portion of the volute region adjacent the throat portion comprising in axial cross-section a recirculation region having a trio of concave portions interconnected by a pair of convex portions which cooperate to provide a flowingly contoured surface of changing axial cross-section in the volute wall portion of the volute region, said concave portions comprising a central concave portion with a variable radius R flanked on each side by one of a pair of side concave portions having fixed radii $r_1$ and $r_2$, wherein R may vary from R greater than one of $r_1$ and $r_2$ near the cutwater to R less than or equal to one of $r_1$ and $r_2$ near the throat portion, said flowingly contoured surface extending past the throat portion into the discharge nozzle region wherein said surface gradually becomes circular in axial cross-section, said contoured interior surface in the volute wall portion of the volute region adjacent the cutwater portion being free of convex portions and thus presenting only a single concave portion, with said contoured interior surface having a smooth, generally uniform surface transition along the length of the volute passage from the cutwater portion to the throat portion in the direction of rotation of the impeller.

8. A removable volute liner according to claim 3, wherein said liner further comprises a pair of side wall portions disposed opposite and spaced apart from one another.

9. A removable volute liner according to claim 3, wherein the liner volute wall portion is connected to the pair of liner side wall portions and the liner is split into two sections through one of a plane which extends perpendicularly to and a plane which extends in the same plane as said longitudinal axis of the impeller drive shaft.

10. A removable volute liner according to claim 3, wherein the liner volute wall portion is connected to the pair of liner side wall portions and the liner is split into a plurality of sections.

11. A removable volute liner according to claim 6, wherein $r_1$ is equal to $r_2$.

12. A removable volute liner according to claim 6, wherein $r_1$ and $r_2$ are variable.

13. A removable volute liner according to claim 12, wherein $r_1$ is equal to $r_2$.

14. A removable volute liner according to claim 6, wherein one of $r_1$ and $r_2$ is fixed and the other is variable.

15. A centrifugal pump according to claim 1, wherein said axial width of said recirculation region decreasing continuously at a first rate in a direction radially outwardly of said impeller, said axial width of said collector region decreasing continuously at a second rate in a direction radially outwardly of said impeller, and said first rate of continuous decrease of said axial width of said recirculation region is greater than said second rate of continuous decrease of said axial width of said collector region.

16. A centrifugal pump according to claim 1, wherein the combined thickness of the impeller shrouds at the outer periphery of the impeller is approximately one-half the width of the recirculation zone at the outer periphery of the impeller.

17. A centrifugal pump according to claim 3, wherein the combined thickness of the impeller shrouds at the outer periphery of the impeller is approximately one-half the width of the recirculation zone at the outer periphery of the impeller.

18. A centrifugal pump according to claim 4, wherein the combined thickness of the impeller shrouds at the outer periphery of the impeller is approximately one-half the width of the recirculation zone at the outer periphery of the impeller.

19. A centrifugal pump according to claim 5, wherein the combined thickness of the impeller shrouds at the outer periphery of the impeller is approximately one-half the width of the recirculation zone at the outer periphery of the impeller.

20. A centrifugal pump according to claim 6, wherein the combined thickness of the impeller shrouds at the outer periphery of the impeller is approximately one-half the width of the recirculation zone at the outer periphery of the impeller.

21. A centrifugal pump according to claim 7, wherein the combined thickness of the impeller shrouds at the outer periphery of the impeller is approximately one-half the width of the recirculation zone at the outer periphery of the impeller.

22. A removable volute liner for a centrifugal pump of the volute type adapted to pump slurries of abrasive material, said pump including a pump casing, an impeller mounted in said casing having a relatively thick shroud at each side thereof defining therebetween at least one impeller discharge opening in an outer periphery of the impeller, and a drive shaft extending axially for rotating said impeller mounted in said casing, said removable volute liner for said pump casing comprising a volute wall portion having a fluid outlet discharge nozzle tangentially leading therefrom and adapted to define a volute passage around said outer periphery of said impeller, said volute passage having a contoured interior surface with a volute region extending from a cutwater to a throat portion, said discharge nozzle extending outwardly from said throat portion, said contoured interior surface in the volute wall portion of the volute region adjacent the throat portion comprising in axial cross-section a circumferentially extending recirculation region adjacent said outer periphery of said impeller extending away from said impeller, said contoured interior surface further comprising a circumferentially extending collector region radially outwardly of said recirculation region, the axial width of said collection region being less than the axial width of said recirculation region, said collector region being interconnected with said recirculation region to provide a flowingly contoured surface of changing axial cross-section in said voltage wall portion of said volute region, said discharge nozzle being of generally circular section at its outer peripheral discharge end, said discharge nozzle at its inner end, constituting said throat portion, and the areas defined by the volute and the outer periphery of the impeller adjacent to and upstream of the throat portion being of generally similar non-circular, generally polygonal shape as viewed in axial cross-section, with the discharge nozzle being so sized and shaped in axial section along its length as to provide a smooth interior surface transition from said non-circular to said circular sectional shapes for limiting turbulence in the flow of the slurry along the discharge nozzle.

* * * * *